US012729444B2

(12) United States Patent
Scotto

(10) Patent No.: US 12,729,444 B2
(45) Date of Patent: Sep. 8, 2026

(54) DEVICE FOR THE CATHODIC PROTECTION OF METAL COMPONENTS OF BOATS

(71) Applicant: Silvestro Scotto, Monte Argentario (IT)

(72) Inventor: Silvestro Scotto, Monte Argentario (IT)

( * ) Notice: Subject to any disclaimer, the term of this patent is extended or adjusted under 35 U.S.C. 154(b) by 515 days.

(21) Appl. No.: 18/285,257

(22) PCT Filed: Apr. 1, 2022

(86) PCT No.: PCT/IB2022/053067

§ 371 (c)(1),
(2) Date: Oct. 1, 2023

(87) PCT Pub. No.: WO2022/208464

PCT Pub. Date: Oct. 6, 2022

(65) Prior Publication Data

US 2024/0183039 A1 Jun. 6, 2024

(30) Foreign Application Priority Data

Apr. 1, 2021 (IT) ..... 102021000008279

(51) Int. Cl.

| | |
|---|---|
| ***C23F 13/04*** | (2006.01) |
| ***C23F 13/12*** | (2006.01) |
| ***C23F 13/18*** | (2006.01) |
| ***C23F 13/20*** | (2006.01) |

(52) U.S. Cl.

CPC ..... *C23F 13/04* (2013.01); *C23F 13/12* (2013.01); *C23F 13/18* (2013.01); *C23F 13/20* (2013.01); *C23F 2213/31* (2013.01)

(58) Field of Classification Search

CPC ..... B63B 59/04

See application file for complete search history.

(56) References Cited

U.S. PATENT DOCUMENTS

| | | | |
|---|---|---|---|
| 2,910,419 | A | 10/1959 | Preiser et al. |
| 3,081,251 | A | 3/1963 | Spector |
| 3,929,606 | A | 12/1975 | Wood |

(Continued)

FOREIGN PATENT DOCUMENTS

| | | | |
|---|---|---|---|
| CN | 111188041 | A | 5/2020 |
| EP | 1 715 229 | A2 | 10/2006 |

(Continued)

*Primary Examiner* — Alexander W Keeling

(74) *Attorney, Agent, or Firm* — Maschoff Brennan

(57) ABSTRACT

A device for cathodic protection including a container body that may include an inner chamber and at least one conductive interface. The device may additionally include an anode, a reference electrode, a direct current source disposed in the container body, and a positive pole electrically connected to the anode. The device may additionally include a control unit that is configured to measure an electric voltage ΔV between the conductive interface and the reference electrode when the device for cathodic protection is immersed in an electrolytic environment. In particular, the device for cathodic protection is configured in such a way that, when the control unit detects an electric voltage $\Delta V > \Delta V^*$, where $\Delta V^*$ is a predetermined threshold value, the direct current source supplies an electric current between the conductive interface and the anode such as to restore a condition $\Delta V \leq \Delta V^*$.

16 Claims, 4 Drawing Sheets

(56) References Cited

U.S. PATENT DOCUMENTS

| | | | | |
|---|---|---|---|---|
| 3,930,977 | A | 1/1976 | Wood | |
| 4,492,877 | A * | 1/1985 | Staerzl | C23F 13/02 204/196.36 |
| 4,592,818 | A | 6/1986 | Cavil et al. | |
| 7,520,487 | B2 | 4/2009 | Mattes | |
| 10,640,877 | B2 | 5/2020 | Simpson et al. | |
| 2013/0292265 | A1 | 11/2013 | Rogacheva et al. | |

FOREIGN PATENT DOCUMENTS

| | | | |
|---|---|---|---|
| RU | 2713898 | C1 | 2/2020 |
| WO | 2004/101851 | A2 | 11/2004 |

* cited by examiner

Fig. 1
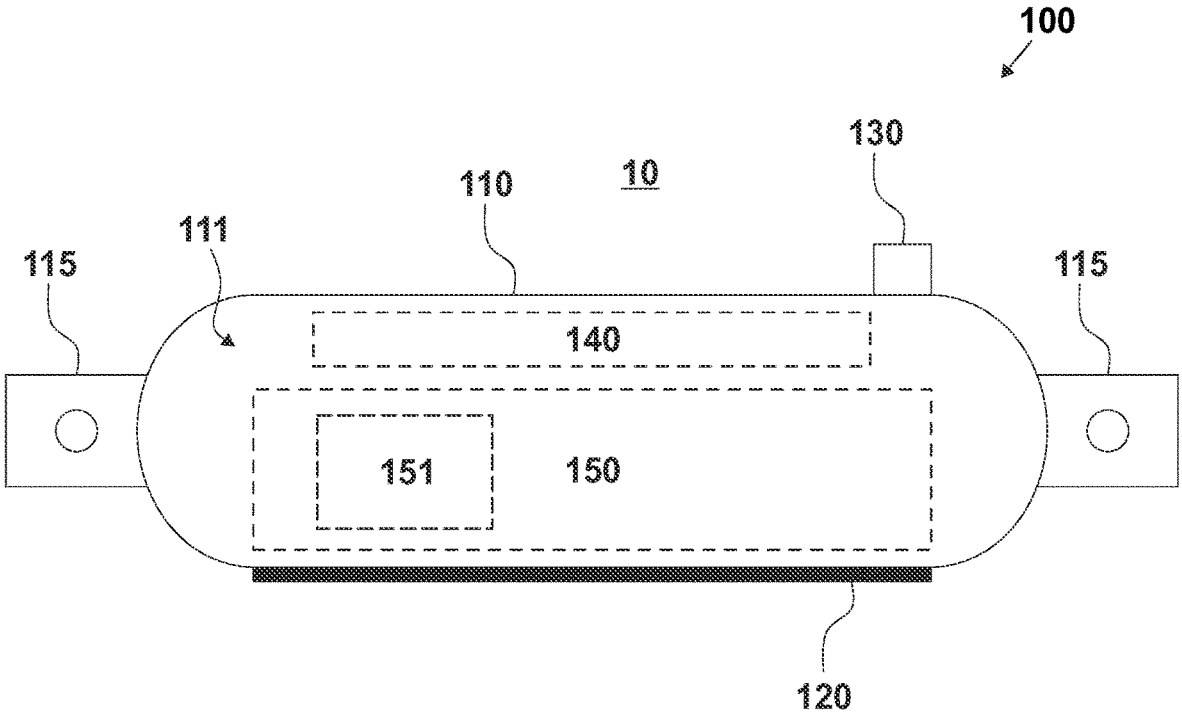
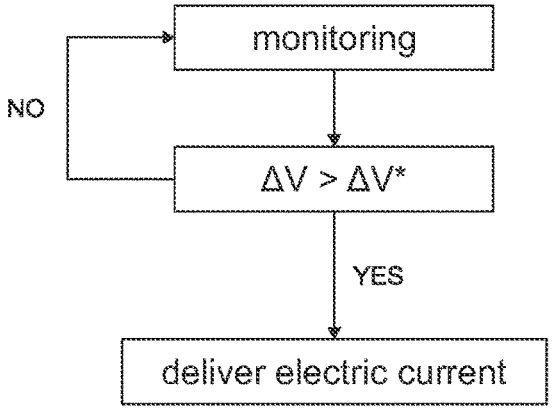
Fig. 1A

DEVICE FOR THE CATHODIC PROTECTION OF METAL COMPONENTS OF BOATS

FIELD OF THE INVENTION

The present invention relates to the field of galvanic corrosion of metal structures exposed to an electrolytic environment, such as fresh water or sea water.

particular, the invention relates to an impressed current cathodic protection device.

DESCRIPTION OF THE PRIOR ART

As well known, galvanic corrosion is an electrochemical reaction that is triggered when metals of different electric potential, immersed in a conductive liquid (called electrolyte), come into contact with each other, directly or by the intervention of a further element that acts as a link. The electric current that is generated is capable of attacking the metal with the lowest potential (anode), usually the least noble metal, corroding it.

When a boat is immersed in water, the latter, being an excellent electrolyte, constitutes a highly favourable environment for triggering this phenomenon, seriously endangering the metals immersed in the boat (propeller, shaft, keel, stem, sea cock, flaps, etc.) and all metal components that are in contact with these elements (valves, pipes, etc.). The higher the degree of salinity of the water, its temperature and the presence of oxygen, the greater the probability of corrosion.

Usually, the most effective solution to protect the boat consists in the use of suitably positioned anodes, which naturally generate the protection current. These less noble metal elements (commonly zinc or aluminium alloy, but also magnesium alloy) corrode, preventing the corrosion of the most important and expensive parts of the boat. For this reason, they are commonly referred to as sacrificial anodes. An example of application of this system is described in WO2004101851.

However, this system involves a progressive wear of the sacrificial anodes, which require constant inspections in order to maintain effective protection of the boat, as well as having to be replaced annually during winter storage. Furthermore, during corrosion, the sacrificial anodes release metal oxides into the marine environment, producing high pollution.

An alternative system is the so-called impressed current cathodic protection, in which the metal to be protected is brought to a safety electric potential by means of a current impressed by an electromotive force, generally supplied by a suitable direct current power supply, called power supply cathode.

Some examples of impressed current cathodic protection are described in RU2713898, U.S. Pat. Nos. 4,592,818, 3,929,606, 3,930,977.

However, in such systems there is a single current generator, located in a remote position with respect to the metal to be protected, which is connected to the various components placed on the hull by means of complex circuitry.

For this reason, such systems are usually used in large boats, where it is possible to obtain space for a current generator capable of powering the protection systems of the entire boat.

Furthermore, the circuits necessary to electrically connect the metal components to be protected with the generator are generally formed on the surface of the hull. This is extremely complex in the case of hulls that are not entirely metal, for example made of fiberglass or wood.

Document EP1715229A2 discloses a corrosion protection device of subsea equipment comprising a charging module, an energy storage module, an electrochemical corrosion prevention module and a control module.

However, the control module is designed to protect the subsea equipment by means of a constant current set by a user. Therefore, the user can set a high current intensity, certainly sufficient to counter the galvanic currents, providing complete protection but also dispersing energy, or he can set a lower current intensity, saving energy but risking losing effectiveness in the protection.

SUMMARY OF THE INVENTION

It is therefore a feature of the present invention to provide an impressed current cathodic protection device that can be used on small boats, for example pleasure boats, or on metal structures or components immersed in an electrolytic environment, guaranteeing total protection from corrosion and at the same time lower energy consumption than prior art devices.

It is also a feature of the present invention to provide such a device that is completely autonomous and can be installed directly on the metal components of the boat or of the submerged structures, without the need for circuitry for connection to a central generator.

It is also a feature of the present invention to provide such a device which can record and transmit in real time information regarding the electrical quantities monitored locally.

These and other objects are achieved by a device for cathodic protection arranged to provide an impressed current cathodic protection of a metal element configured to be immersed in an electrolytic environment, the device for cathodic protection comprising:

- a container body comprising an inner chamber and at least one conductive interface arranged to be electrically connected to the metal element;
- an anode integral to the container body and having a portion which faces externally with respect to the container body;
- a direct current source disposed in the container body and comprising a negative pole, electrically connected to the conductive interface, and a positive pole, electrically connected to the anode;

whose main feature is that it comprises furthermore:

- a reference electrode integral to the container body and having a portion which faces externally with respect to the container body;
- a control unit disposed in the container body and configured to measure an electric voltage $\Delta V$ between the conductive interface and the reference electrode when the device for cathodic protection is immersed in an electrolytic environment;
- and that it is configured in such a way that, when the control unit detects an electric voltage $\Delta V > \Delta V^*$, where $\Delta V^*$ is a predetermined threshold value, the direct current source supplies an electric current I between the conductive interface and the anode such as to restore a condition $\Delta V \leq \Delta V^*$.

In this way, the present invention allows to obtain cathodic protection at impressed currents of the metal element, avoiding the use of sacrificial anodes, but at the same time having energy autonomy of the device or devices placed on the metal elements. This makes it possible to do without a central energy source, remote from the device, which, on the other hand, the prior art impressed current cathodic protection systems need.

In particular, the conductive interface is configured for mechanically fastening the container body to the metal element.

Advantageously, the conductive interface comprises at least one flange configured for fastening the container body to the metal element both mechanically that electrically.

In particular, the container body comprises hermetic sealing elements configured to insulate the inner chamber by the electrolytic environment.

Advantageously, the anode comprises at least one among the following elements:

titanium;

titanium activated with iridium and ruthenium;

titanium activated with platinum;

niobium activated with platinum;

a combining the previous.

In particular, the control unit is also arranged to generate a register in which is reported the trend over time of electrical parameters selected from the group consisting of:

the electric voltage ΔV between the conductive interface and the reference electrode;

the electric current I supplied by the direct current source;

an electric voltage $\Delta V_G$ between the positive pole and the negative pole of the direct current source;

status data of said direct current source;

a combining the previous.

In this way, it is possible to monitor the trend of the parameters over time and create statistics and/or forecasts that can be used to change the protection currents.

Advantageously, in the inner chamber an antenna is also disposed arranged to connect wireless the control unit to a remote device. The device can be, for example, a smartphone, a tablet, a computer or a server that collects data.

In particular, the control unit is adapted to transmit data present on the register by means of the antenna.

Advantageously, a recharging device is also provided arranged to recharge the direct current source, in particular by means of motive energy or solar energy.

Advantageously, the direct current source is adapted to accumulate energy by wireless charging. For example, the battery can be recharged using magnetic induction or resonance devices.

particular, the device can comprise a device for visually indicating the state of the battery and/or the operating state of the device, such as in particular an LED.

In particular, the recharging device is selected from the group consisting of:

a solar panel arranged on a portion of the container body;

a direct current generator connected to the container body and having a rotor configured to be propelled by a relative movement between the device for cathodic protection and the electrolytic environment;

an inertial generator arranged in the container body and configured for exploit oscillations of the metal element.

Advantageously, the control unit is configured for adjusting the predetermined threshold value ΔV* by means of the remote device.

In particular, the control unit is configured for automatically adjusting the predetermined threshold value ΔV* on the basis of determined environmental parameters.

Advantageously, the metal element is configured to be immersed in an electrolytic fluid and the determined environmental parameters are selected from the group consisting of:

level of oxygen of the electrolytic fluid;

level of salinity of the electrolytic fluid;

speed of movement of the metal element in the electrolytic fluid;

a combining the previous.

In particular, the device for cathodic protection has a maximum length comprised between 3 cm and 30 cm.

Advantageously, the container body has a hydrodynamic shape, in particular a rounded shape.

BRIEF DESCRIPTION OF THE DRAWINGS

The invention will be now shown with the following description of some exemplary embodiments, exemplifying but not limitative, with reference to the attached drawings in which:

FIG. 1 shows a possible exemplary embodiment of the device for cathodic protection according to the present invention;

FIG. 1A shows a logic diagram of the operation of the device for cathodic protection;

DESCRIPTION OF SOME PREFERRED EXEMPLARY EMBODIMENTS

Figure 2:
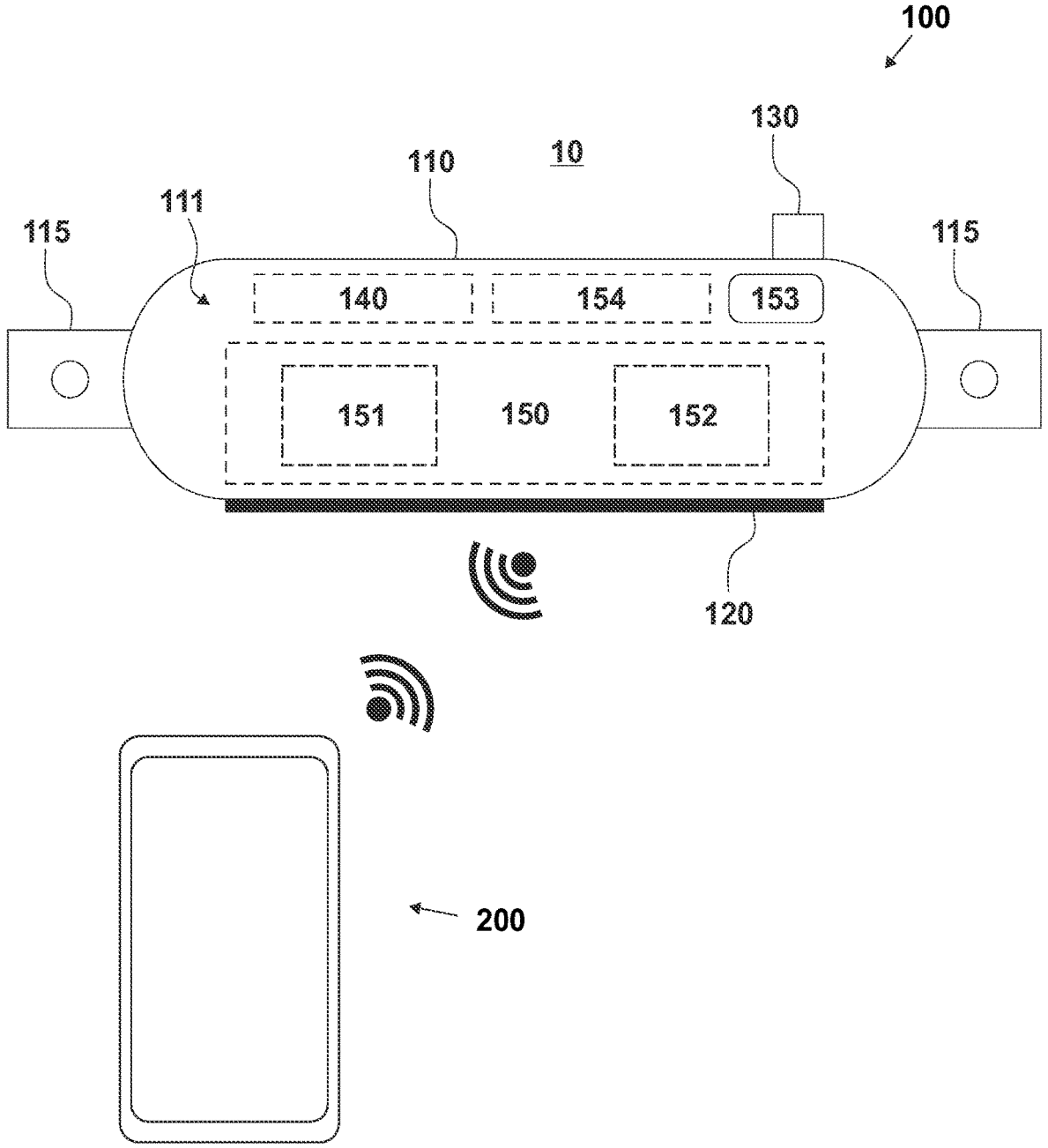
FIG. 2 shows a possible exemplary embodiment of the device for cathodic protection according to the present invention, comprising a recharging device, an antenna for wireless connection with a remote device and a visual signalling device.

In FIG. 1 a preferred exemplary embodiment of the device for cathodic protection 100 is shown, according to the present invention, arranged to provide an impressed current cathodic protection of a metal element 10 of a boat or of other structure when this element 10 is immersed in an electrolytic environment, such as sea water or fresh water.

In particular, the device for cathodic protection 100 comprises a container body 110 comprising an inner chamber 111, insulated by the outside, and two conductive interface 115, which allow the mechanical and electrical connection between the container body 110 and the metal element 10 to be to protect.

The device for cathodic protection 100 also comprises an anode 120 and a reference electrode 130, both arranged externally to the container body 110 in contact with the electrolytic liquid.

Furthermore, a direct current source 140, in particular a rechargeable battery, and a control unit 150 are placed in the internal chamber.

In particular, the battery 140 is connected by the negative pole to a conductive interface 115 and with the positive pole to the anode 120, creating a circuit by means of the electrolytic liquid.

The control unit 150 is instead configured to measure the electric voltage ΔV between the conductive interface 115 and the reference electrode 130.

With reference even at FIG. 1A, the device 100 is configured in such a way that, when the control unit 150 detects an electric voltage ΔV>ΔV*, where ΔV* is a predetermined value, the battery 140 supplies an electric current I between the conductive interface 115 and the anode 120 such that the conductive interface 115, and therefore the metal element 10 connected to it, acts as a cathode, allowing to restore a condition $\Delta V \leq \Delta V^*$.

In this way, the present invention allows to obtain cathodic protection with impressed currents of the metal element 10, avoiding the use of sacrificial anodes, but at the same time having energy autonomy of the device or devices placed on the metal elements. This makes it possible to do without a central generator, which the prior art cathodic protection systems with impressed currents need instead.

In particular, the control unit can comprise an electronic board 151 adapted to generate a register in which is reported the trend over time of electrical parameters such as, for example, the electric voltage $\Delta V$ between the conductive interface 115 and the reference electrode 130, the electric current I supplied by the battery 140 and the electric voltage $\Delta V_G$ of the battery 140. Furthermore, the control unit can record any corrosion peaks and "over protection" phenomena.

In this way, it is possible to monitor the trend of the parameters over time and create statistics and/or forecasts that can be used to change the protection currents.

Figure 3:
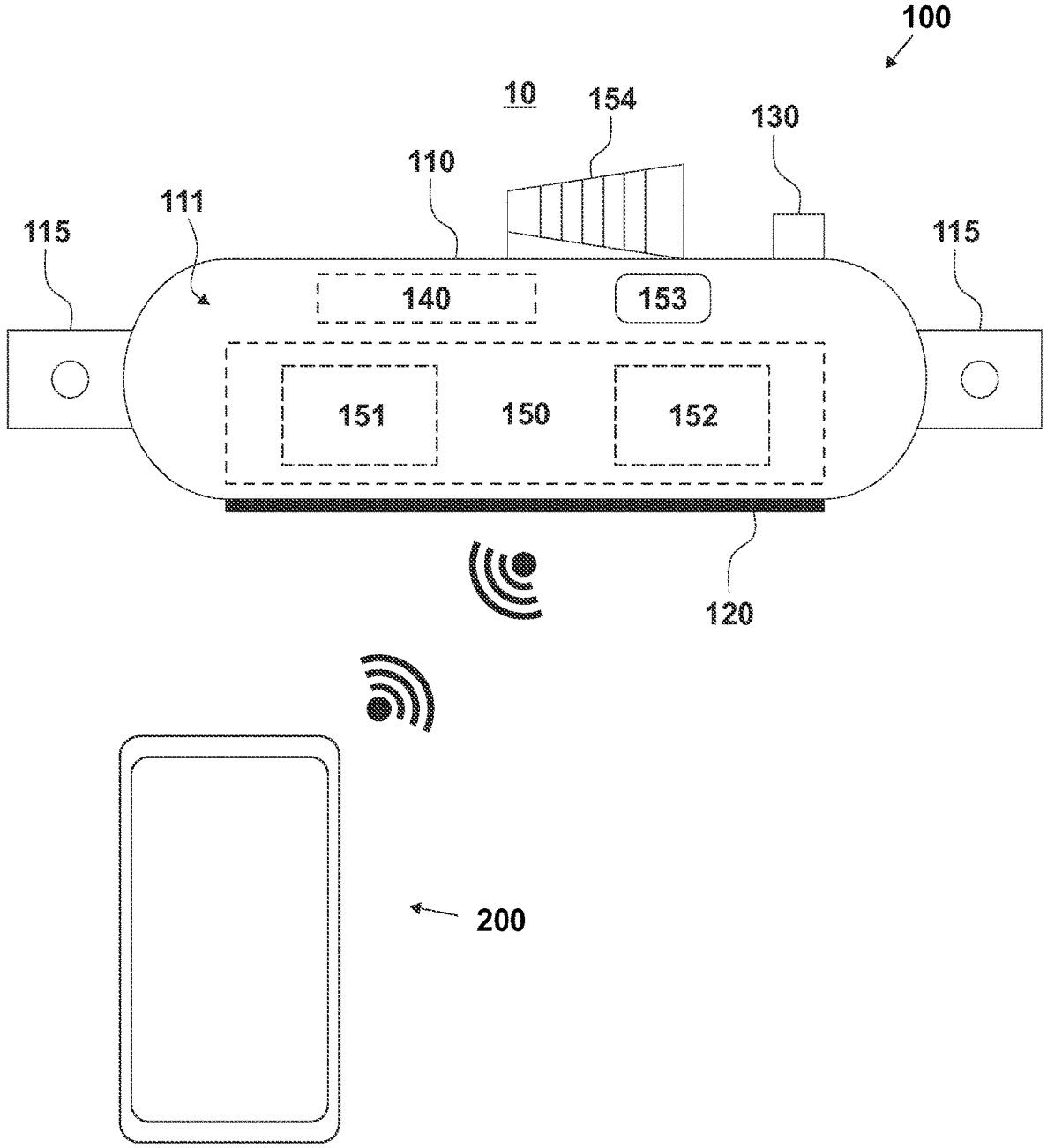
FIG. 3 shows an exemplary embodiment of the device for cathodic protection in which an external turbine is present as a recharging device.
Figure 4:
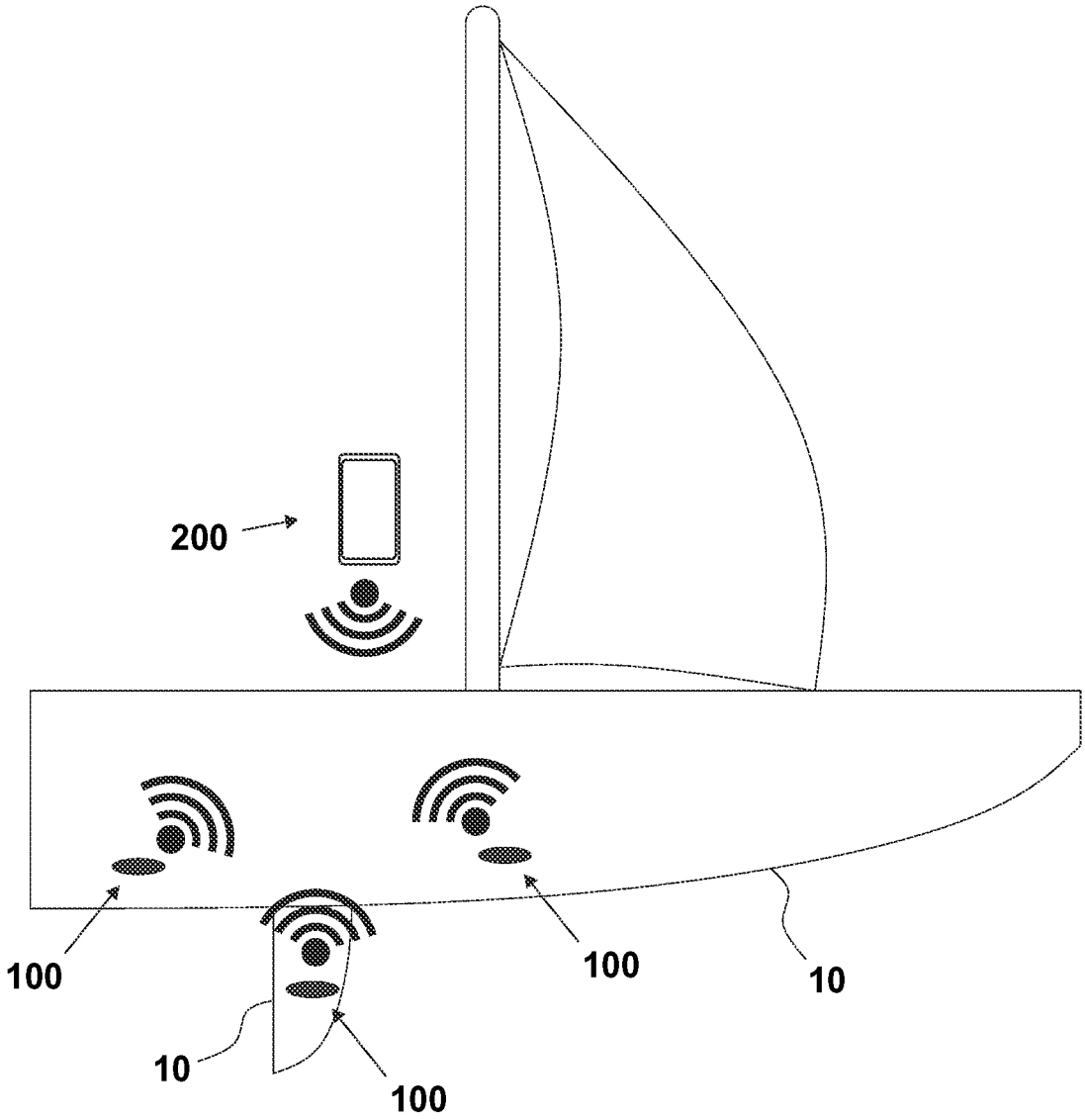
FIG. 4 schematically shows a possible application of some cathodic protection devices, according to the present invention, arranged on the hull of a boat.

With reference to FIGS. 2 and 3, in an exemplary embodiment of the invention, the control unit may also comprise an electronic board 152 and an antenna arranged to connect wireless the control unit 150 to a remote device 200, such as a smartphone, a tablet, a computer or a server that collects data, for transmitting data present in the register of the monitored electrical parameters.

This way, by the remote device it is possible to monitor in real time the recorded parameters, the corrosion/protection status of the metal element 10 and the battery status, allowing to intervene in the event of a breakdown, or need for maintenance of the device, or even if you want to adjust the threshold value $\Delta V^*$ of the electric voltage beyond which the protection current is activated.

Advantageously, a recharging device 154 is also provided arranged to recharge the battery 140, for example by means of motive energy or solar energy.

In particular, this recharging device 154 can be, for example, a hydroelectric turbine arranged outside the internal chamber 111 (FIG. 3). Alternatively, the recharging device can be a gyroscopic generator actuated by the wave motion and placed inside the internal chamber 111. This second solution allows to avoid wear of the recharging device that can derive from immersion in a marine environment or, in general, in an electrolytic environment.

In this way, the direct current source can be recharged by energy derived from the movement of the boat or from the wave motion in the event of a long stop.

Alternatively, the charging device 154 can be a solar panel placed remotely with respect to the cathodic protection device 100, for example on the hull or above deck of the boat.

Furthermore, the battery 140 can be rechargeable by wireless charging. In this way, it is possible to recharge the battery without having to remove the device 100 from the hull. For example, the battery can be recharged using magnetic induction or resonance devices.

Furthermore, the device 100 can comprise a visual signalling device 153 of the battery status and/or the operating status of the device, such as in particular an LED.

In this way, it is possible to make a quick visual inspection of the device 100 and verify its correct functioning (for example, green light or intermittent green light), the failure or imminent depletion of the battery (for example, red light or flashing red light) or total breakdown of the device or battery (no light).

The foregoing description exemplary embodiments of the invention will so fully reveal the invention according to the conceptual point of view, so that others, by applying current knowledge, will be able to modify and/or adapt for various applications such embodiment without further research and without parting from the invention, and, accordingly, it is therefore to be understood that such adaptations and modifications will have to be considered as equivalent to the specific embodiments. The means and the materials to realise the different functions described herein could have a different nature without, for this reason, departing from the field of the invention. It is to be understood that the phraseology or terminology that is employed herein is for the purpose of description and not of limitation.

The invention claimed is:

1. A device for cathodic protection arranged to provide an impressed current cathodic protection of a metal element configured to be immersed in an electrolytic environment, said device for cathodic protection comprising:

a container body comprising an inner chamber and at least one conductive interface arranged to be electrically connected to said metal element;

an anode integral to said container body and having a portion which faces externally with respect to said container body;

a direct current source disposed in said container body and comprising a negative pole, electrically connected to said conductive interface, and a positive pole, electrically connected to said anode;

a reference electrode integral to said container body and having a portion which faces externally with respect to said container body; and a control unit disposed in said container body and configured to measure an electric voltage $\Delta V$ between said conductive interface and said reference electrode when said device for cathodic protection is immersed in an electrolytic environment, wherein when said control unit detects an electric voltage $\Delta V > \Delta V^*$, where $\Delta V^*$ is a predetermined threshold value, said direct current source supplies an electric current/between said conductive interface and said anode such as to restore a condition $\Delta V \leq \Delta V^*$.

2. The device for cathodic protection, according to claim 1, wherein said conductive interface is configured for mechanically fastening said container body to said metal element.

3. The device for cathodic protection, according to claim 1, wherein said conductive interface comprises at least one flange configured for fastening said container body to said metal element both mechanically that electrically.

4. The device for cathodic protection, according to claim 1, wherein said container body comprises hermetic sealing elements configured to insulate said inner chamber from said electrolytic environment.

5. The device for cathodic protection, according to claim 1, wherein said anode comprises at least one among the following elements:

titanium;

titanium activated with iridium and ruthenium;

titanium activated with platinum;

niobium activated with platinum; or a combination of the foregoing.

6. The device for cathodic protection, according to claim 1, wherein said control unit is also arranged to generate a register in which is reported a trend over time of electrical parameters selected from the group consisting of:

said electric voltage $\Delta V$ between said conductive interface and said reference electrode;

said electric current I supplied by said direct current source;

an electric voltage $\Delta V_G$ between said positive pole and said negative pole of said direct current source;

status data of said direct current source; or a combination of the foregoing.

7. The device for cathodic protection, according to claim 1, wherein in said inner chamber an antenna is also disposed arranged to connect wireless said control unit to a remote device.

8. The device for cathodic protection, according to claim 6, wherein said control unit is adapted to transmit data present on said register by means of an antenna.

9. The device for cathodic protection, according to claim 1, wherein a recharging device is also provided arranged to recharge said direct current source.

10. The device for cathodic protection, according to claim 1, wherein said direct current source is adapted to accumulate energy by wireless charging.

11. The device for cathodic protection, according to claim 9, wherein said recharging device is selected from the group consisting of:

a solar panel arranged on a portion of said container body;

a direct current generator connected to said container body and having a rotor configured to be propelled by a relative movement between said device for cathodic protection and said electrolytic environment;

an inertial generator arranged in said container body and configured for exploiting oscillations of said metal element.

12. The device for cathodic protection, according to claim 7, wherein said control unit is configured for adjusting said predetermined threshold value $\Delta V^*$ by means of said remote device.

13. The device for cathodic protection, according to claim 1, wherein said control unit is configured for automatically adjusting said predetermined threshold value $\Delta V^*$ based on determined environmental parameters.

14. The device for cathodic protection, according to claim 13, wherein said metal element is configured to be immersed in an electrolytic fluid and wherein said determined environmental parameters are selected from the group consisting of:

level of oxygen of said electrolytic fluid;

level of salinity of said electrolytic fluid;

speed of movement of said metal element in said electrolytic fluid;

a combination of the foregoing.

15. The device for cathodic protection, according to claim 1, wherein said device for cathodic protection has a maximum length comprised between 3 cm and 30 cm.

16. The device for cathodic protection, according to claim 1, wherein said container body has a hydrodynamic shape, in particular a rounded shape.

* * * * *